US005964967A

United States Patent [19]

Bryant et al.

[11] Patent Number: 5,964,967

[45] Date of Patent: Oct. 12, 1999

[54] METHOD OF TREATMENT OF METAL MATRIX COMPOSITES

[75] Inventors: Timothy Frederick Bryant, Chertsey; Simon Brian Dodd, Shepperton; Stephen Mark Flitcroft, Basingstoke; William Sinclair Miller, Maidstone; Roger Moreton; Christopher John Peel, both of Fleet, all of United Kingdom

[73] Assignees: The Secretary of State for Defence in Her Britannic Majesty's Government of the United Kingdom of Great Britain and Northern Ireland; Defence Research Agency, both of Hampshire, United Kingdom

[21] Appl. No.: 08/308,205

[22] Filed: Sep. 19, 1994

Related U.S. Application Data

[63] Continuation of application No. 07/888,287, May 26, 1992, abandoned, which is a continuation of application No. 07/698,391, May 10, 1991, abandoned.

[30] Foreign Application Priority Data

Jun. 8, 1990 [GB] United Kingdom ..... 9012810

[51] Int. Cl.[6] ..... B22F 1/00

[52] U.S. Cl. ..... 148/514; 148/690; 148/693; 148/697; 75/229; 75/236; 75/237; 75/249; 419/14

[58] Field of Search ..... 148/690, 693, 148/697, 514; 419/14, 15, 16, 17; 75/228, 229, 236, 237, 249; 428/545

[56] References Cited

U.S. PATENT DOCUMENTS

| | | | |
|---|---|---|---|
| 4,265,676 | 5/1981 | Nes et al. | 148/11.5 A |
| 4,358,324 | 11/1982 | Mahoney et al. | 148/690 |
| 5,066,342 | 11/1991 | Rioja et al. | 148/693 |

FOREIGN PATENT DOCUMENTS

| | | | |
|---|---|---|---|
| 0 326 337 | 8/1989 | European Pat. Off. . | |
| 0213850 | 12/1983 | Japan | 148/11.5 A |
| 58-213850 | 12/1983 | Japan . | |
| 0168625 | 7/1987 | Japan | 148/11.5 Q |
| 2 075 059 | 11/1981 | United Kingdom . | |
| 2 137 227 | 10/1984 | United Kingdom . | |
| 2 137 656 | 10/1984 | United Kingdom . | |

OTHER PUBLICATIONS

English language abstract of JP 59126762 "Heat Treatment of pptn . . . " Jul. 1984.

English language abstract of JP 58181851 "Aluminum Alloy with . . . " Oct. 1983.

*Primary Examiner*—Sikyin Ip

*Attorney, Agent, or Firm*—Nixon & Vanderhye

[57] ABSTRACT

A treatment process for a composite comprising a matrix of a precipitation hardenable aluminum alloy and a particulate or short fiber ceramic reinforcement. The process includes hot and/or cold working the composite, subjecting the composite to a controlled heating step in which the composite is raised from ambient temperature to a temperature of from 250 to 450° C. at a rate of temperature increase less than 1000° C. per hour, and subjecting the resulting heat treated composite to a solution treating step.

7 Claims, 1 Drawing Sheet

METHOD OF TREATMENT OF METAL MATRIX COMPOSITES

Figure 1:
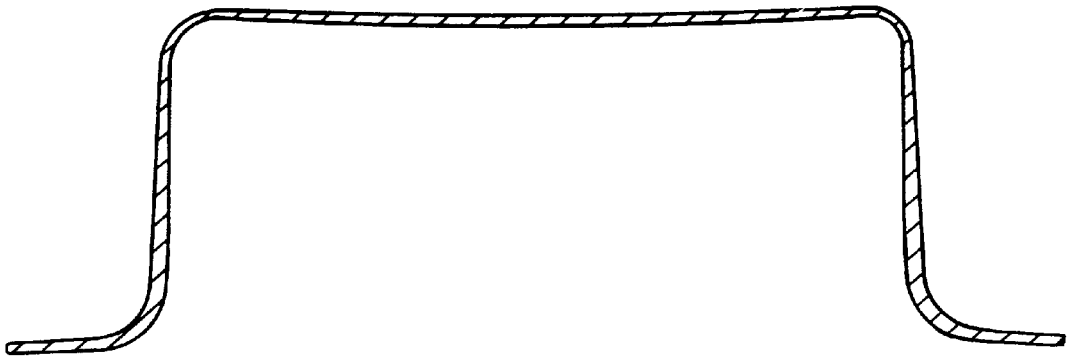

This is a Rule 62 Continuation of application Ser. No. 07/888,287, filed May 26 1992, now abandoned, which is a continuation of application Ser. No. 07/698,391, filed May 10, 1991, now abandoned.

This invention relates to a method of treatment of metal matrix composites.

BACKGROUND OF THE INVENTION

In the manufacture of articles from precipitation hardenable high strength aluminium alloys, the final thermo-mechanical treatment involves solution treatment of the alloy followed by quenching and then natural or artificial ageing. This process results in hardening of the alloy.

Prior to the final thermo-mechanical treatment, the alloy can be hot or cold worked in a number of different ways, for example rolling, extruding or forging. This stage in the preparation of a material is referred to as the intermediate thermo-mechanical treatment.

It is known to prepare composites comprising a particulate or short fibre ceramic reinforcement in a matrix comprising a precipitation hardenable aluminium alloy. The conventional treatments for such composites have followed the same procedure as for the unreinforced alloys, i.e. solution treating the material and then artificially or naturally ageing it to precipitate the strengthening phase. We have now found that introduction of an additional step between the intermediate and final thermo-mechanical treatments leads to a surprising improvement in the properties of such composites.

DESCRIPTION OF THE INVENTION

Accordingly, the present invention provides a treatment process for a composite comprising a matrix of a precipitation hardenable aluminium alloy and a particulate or short fibre ceramic reinforcement, which comprises a hot and/or cold working step and a subsequent solution treating step; characterised in that, after the hot and/or cold working step and before the solution treating step, a controlled heating step is applied in which the composite is raised from ambient temperature to a temperature of from 250 to 450° C., the rate of temperature increase being less than 1000° C. per hour, preferably less than 600° C. per hour, typically from 3 to 10° C. per hour. Very slow rates, for example 3 to 10° C. per hour, are satisfactory, but time-consuming.

The aluminium alloy which forms the matrix of the composite may be any alloy which undergoes precipitation hardening. Typical alloys include aluminium-copper-magnesium and aluminium-lithium-copper-magnesium alloys IADS 2124 and 8090. The reinforcement may be any particulate or short fibre ceramic, but is preferably silicon carbide, especially particulate silicon carbide. The weight ratio of matrix alloy to ceramic may vary widely, but is preferably from 2:1 to 9:1, especially from 3:1 to 6:1.

In the controlled heating step, the rate of temperature increase of the composite is less than 1000° C. per hour, preferably less than 600° C. per hour. In conventional treatments, the composite is placed directly in a hot heat-treatment furnace at the desired temperature. Under these conditions, the heating rate of the composite is extremely high, typically 600° C. per minute. In the process of the present invention, the composite is placed in the heat-treatment furnace which is preferably at ambient temperature but may be a little above, and the furnace temperature is increased at the desired rate. This slow heating is crucial to the success of the invention. Once the composite has reached the desired temperature in the range of from 250 to 450° C., it may be allowed to dwell for a period at that temperature, but this is not essential. The temperature may then be raised again, up to the solution treatment temperature. Alternatively, the composite may be cooled down, the subsequent heating to the solution treatment temperature being commenced from ambient.

The precipitation hardening step is conventional, and includes solution treatment of the composite followed by artificial or natural ageing. Solution treatment is the rapid heating of the alloy up to a temperature at which the alloy matrix forms a solid solution whilst avoiding localised melting; temperatures of at least 500° C. are generally suitable. Following this heating, the composite is quenched and subsequently aged, to enable precipitation and consequent hardening to occur. Natural ageing involves allowing the composite to stand at ambient temperature for a prolonged period, preferably for a minimum of at least 7 days. Artificial ageing involves heating the composite above ambient temperature, typically to a temperature of from 100 to 200° C. for a shorter period of time, typically from 1 to 48 hours, followed by air quenching.

The hot and/or cold working step is also conventional. It may involve a number of different treatments, including rolling, extruding or forging, with or without intermediate annealing. It is following completion of this working that the controlled heating step characteristic of the present invention is applied. The benefits of the invention may be obtained irrespective of the details of the hot or cold working, but the benefits are particularly marked when the working step has been a hot rolling step.

If desired, material prepared using the process according to the invention may be subjected to a superplastic forming step. Most surprisingly, it has been found that the process according to the invention improves the superplasticity of the composites.

The process of the invention leads to composites with improved properties. For some samples, the ductility of the composites is greater than would have been predicted. For others, the strength is greater. In addition, the composites produced have very consistent properties. The design strength of a material used by engineers and designers is generally calculated using the standard deviation from the average strength of the material, see for example Military Handbook V, compiled by the Department of Defence, Washington D.C., published by Naval Publications and Forms Centre, Philadelphia, which gives details of the calculation of standard A and B values for a material using standard deviations. The standard deviation in strength of composites made by the process of the present invention is lower than that of composites made by conventional processes. This is a major advantage.

EXAMPLES

The following Examples illustrate the invention.

Example 1

The starting material for this Example was a hot isostatically pressed billet, commercially available from BP, prepared from blended powders of 2124 alloy and silicon carbide particles. The 2124 alloy had the nominal composition (wt %): Al base; 3.8/4.9 Cu; 1.2/1.8 Mg; 0.3/0.9 Mn; 0.2 max Si; 0.3 max Fe; 0.25 max Zn; 0.1 max Cr; 0.15 max Ti; 0.2 max Zr and Ti. The silicon carbide particles had a mean diameter of 3 microns. The weight ratio of alloy to silicon carbide was 80:20.

Working Step (1)

The pressed billet was hot forged to plate form and then hot rolled to 5 mm thickness with the material heated to 475° C. prior to each pass and with the rolls heating to approximately 100° C. to avoid quenching the surface. In this and all other rolling practices described here, a reduction in thickness of 10% per pass was achieved.

This 5 mm sheet was then further worked in three different ways as follows:

Route a

Annealing at 300° C. for 24 hours; cold rolling to 3.1 mm thickness (a predetermined level above the onset of cracking); annealing at 300° C. for 24 hours; cold rolling down to 2 mm thickness.

Route b

Preliminary treatment (high temperature anneal or solution treatment) by placing in a cold furnace, raising temperature to 495° C., holding for ½ hour, removing to cool naturally in air; cold rolling to 3.6 mm; repeat of preliminary treatment regime; cold rolling to 2 mm.

Route c

Hot rolling down to 2 mm, with material heated to 475° C. and rolls heated to approximately 100° C., with intermediate reheats of the material between passes.

Controlled Heating Step (2)

The 2 mm sheet was heated at a rate of 6° C. per hour to a temperature of 400° C., and cooled in air to ambient temperature.

Solution Treatment and Precipitation Hardening Step (3)

The 2 mm sheet was rapidly heated to a solution treatment temperature of 505° C., and held at this temperature for ½ hour to achieve thermal equilibrium. The sheet was then quenched in cold water. The quenched material was aged naturally at ambient temperature for 23 days.

The process according to the invention was carried out by operating steps (1), (2) and (3) above. Comparative data was obtained by operating steps (1) and (3) only. The results are given in the following Table 1. All measurements were made using conventional techniques and the figures are mean figures taken over a minimum of four measurements.

The results show that the introduction of the controlled heating step (2) leads, irrespective of method of working, to an increase in the strength of the material after precipitation hardening. Most surprisingly, the ductility of the material is also increased.

Example 2

The starting material for this Example was a billet of SiC-reinforced metal matrix composite similar to that of Example 1 except that the matrix alloy was aluminium-lithium alloy 8090. This alloy has the following composition (wt %):- Al base; 2.4% Li; 1.3 Cu; 0.8 Mg; 0.12 Zr; 0.1 max Fe; 0.05 max Si.

A 2 mm sheet was prepared as in working step (1), using working route c, as described in Example 1. The sheet was then heated to a temperature of 540° C. at a rate of 5° C. every 5 minutes, followed by cold water quenching.

The resulting sheet was deformed by British Aerospace Military Aircraft Limited using a superplastic forming rig, into a rectangular box section at a strain rate of $5\times10^{-4}$ $sec^{-1}$ and using established techniques for 8090 alloy. A good box shape was formed without tearing. FIG. 1 shows a longitudinal section through the box.

Figure 2:
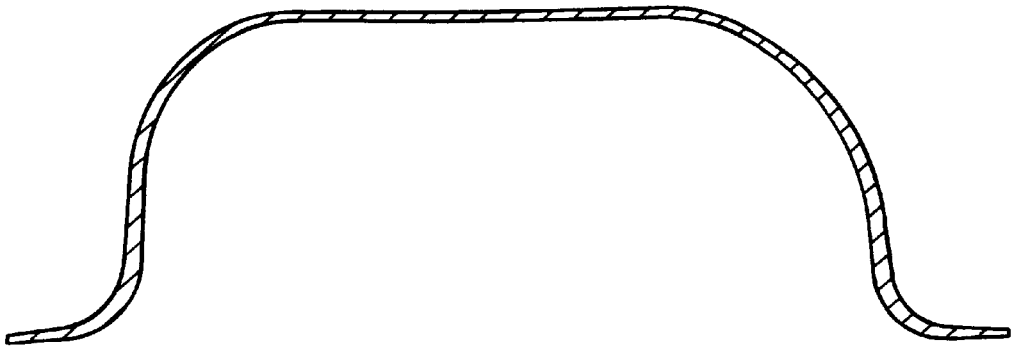

In a comparative test, an identical sheet was prepared in the same way except that the slow heating prior to reaching the solution treatment temperature of 540° C. was replaced by a conventional rapid heating. An attempt to form the sheet into a box using a superplastic forming rig resulted in cavitation or tearing of the sheet before the box was completely formed. FIG. 2 shows a longitudinal section through the box. Comparison of FIGS. 1 and 2 clearly shows the benefit of the process according to the invention.

Example 3

This Example illustrates the effect of slow heat-up rates compared with a rapid conventional treatment. The material used was the material described in Example 1, Route C.

2 mm sheet was placed in a heat-treatment furnace at ambient temperature, and the temperature raised to 400° C. at a defined rate. The sheet was subsequently solution treated by heating to 505° C., cold water quenched, and naturally aged for a period greater than 7 days. In a comparison experiment, a 2 mm sheet was placed directly in a hot furnace at 505° C., followed by quenching and ageing; under such conditions, the sample attains temperature at a rate of about 600° C. per minute.

The results are given in Table 2, and show that the slow heating step produces composites with a significantly greater proof strength than the conventional treatment.

TABLE 1

| Treatment | Working Type | Ultimate Tensile Strength (MPa) | Elongation to break (%) | Proof Strength (MPa) 0.1% | 0.2% | 0.5% | Modulus Tensile (GPa) |
|---|---|---|---|---|---|---|---|
| According to Invention | Route a | 619 | 9.6 | 349 | 380 | 426 | 105.7 |
| Comparative | | 610 | 8.9 | 344 | 374 | 422 | 100.2 |
| According to Invention | Route b | 627 | 8.3 | 422 | 439 | 466 | 101.4 |
| Comparative | | 621 | 7.0 | 412 | 432 | 461 | 102.0 |
| According to Invention | Route c | 598 | 7.2 | 389 | 412 | 448 | 100.7 |
| Comparative | | 567 | 5.5 | 355 | 384 | 424 | 98.6 |

TABLE 2

| Treatment: Rate of Heating | Ultimate Tensile Strength (MPa) | Elongation to Break (%) | Proof Strength 0.2% (MPa) |
|---|---|---|---|
| According to invention: | | | |
| 600° C./hour | 560 | 7.2 | 368 |
| 60° C./hour | 567 | 6.8 | 358 |
| 6° C./hour | 562 | 7.3 | 365 |
| Conventional: about 600° C./minute | 560 | 7.2 | 344 |

Example 4

The general procedure described in Example 3 was repeated using a heating rate of 6° C./hour, with a large number of samples. The conventional treatment was also repeated with a large number of samples. The samples were prepared by hot extruding the billets to a rectangular section 32 mm×7 mm, the extrusion temperature being in the range 300–375° C. Statistical analysis of the results showed the ductility of 24 samples prepared according to the invention to be significantly greater than that of 16 conventionally prepared samples. Moreover, the standard deviation of the average proof strength was very significantly lower for samples according to the invention than for conventionally prepared samples. The results are given in Table 3, which shows the mean and standard deviations for each variable.

TABLE 3

| Treatment: Rate of Heating | Ultimate Tensile Strength (MPa) | Elongation to Break (%) | Proof Strength 0.2% (MPa) |
|---|---|---|---|
| According to invention: 6° C./hour | 615 ± 17 | 7.6 ± 1.1 | 419 ± 12 |
| Conventional: 600° C./minute | 611 ± 19 | 6.9 ± 0.9 | 417 ± 19 |

Example 5

The material used in this Example was that described in Example 2.

2 mm sheet was placed in a heat-treatment furnace at ambient temperature, and the temperature raised to 350° C. at a rate of 6° C. per minute. The sheet was subsequently solution treated by heating to 540° C., cold water quenched, and artificially aged by heating at 150° C. for 1 hour. In a comparison experiment, a 2 mm sheet was placed directly in a hot furnace at 540° C., followed by quenching and artificial ageing.

The results are given in Table 4.

TABLE 4

| Treatment: Rate of Heating | Ultimate Tensile Strength (MPa) | Elongation to Break (%) | Proof Strength 0.2% (MPa) |
|---|---|---|---|
| According to invention: 6° C./minute | 523 | 4.1 | 423 |
| Conventional: about 540° C./minute | 519 | 2.6 | 428 |

We claim:

1. A treatment process for a composite comprising a matrix of a precipitation hardenable aluminum alloy and a particulate ceramic reinforcement, said process comprising the steps of:

providing a composite prepared by hot pressing a blended powder of said precipitation hardenable aluminum alloy and said particulate ceramic reinforcement;

subjecting said composite to an intermediate thermo-mechanical treatment step to produce a treated composite;

subjecting said treated composite to a controlled heating step in which the temperature of said treated composite is raised from ambient temperature to a temperature of from 250 to 450° C. at a rate of temperature increase of from 3 to 100° C. per hour from ambient temperature to 450° C. to produce a temperature treated composite; and subjecting said temperature treated composite to a final thermo-mechanical treatment step which includes a solution treatment step.

2. The process as claimed in claim 1, in which the aluminum alloy which forms the matrix of the composite is IADS 2124 or 8090.

3. The process as claimed in claim 1, in which the ceramic reinforcement is silicon carbide.

4. The process as claimed in claim 1, in which the weight ratio of matrix alloy to ceramic reinforcement is from 2:1 to 9:1.

5. The process as claimed in claim 1, in which the solution treatment step comprises heating to a temperature of at least 500° C.

6. The process as claimed in claim 1, in which the hot and/or cold working step includes a hot rolling step.

7. A process as claimed in claim 1, which also comprises a subsequent superplastic forming step.

* * * * *